US006486837B2

(12) United States Patent
Spiegel et al.

(10) Patent No.: US 6,486,837 B2
(45) Date of Patent: Nov. 26, 2002

(54) ANTENNA STRUCTURES

(75) Inventors: Marko Spiegel, LaFox, IL (US); William H. Darden, IV, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/829,027

(22) Filed: Apr. 9, 2001

(65) Prior Publication Data

US 2002/0145567 A1 Oct. 10, 2002

(51) Int. Cl.[7] ..... H01Q 1/24

(52) U.S. Cl. ..... 343/702; 343/700 MS; 343/767

(58) Field of Search ..... 343/702, 700 MS, 343/767, 770; 455/89, 90; 29/600

(56) References Cited

U.S. PATENT DOCUMENTS

| | | | | |
|---|---|---|---|---|
| 5,929,813 A | * | 7/1999 | Eggleston | 343/700 MS |
| 6,031,494 A | * | 2/2000 | Okabe et al. | 343/702 |
| 6,184,834 B1 | * | 2/2001 | Utsumi et al. | 343/702 |
| 6,271,794 B1 | * | 8/2001 | Geeraert | 343/700 MS |
| 6,359,598 B1 | * | 3/2002 | Sullivan | 343/702 |

FOREIGN PATENT DOCUMENTS

| | | | |
|---|---|---|---|
| EP | 0 867 967 A2 | 9/1998 | H01Q/1/22 |
| EP | 0 913 502 A1 | 5/1999 | C25D/5/56 |
| EP | 0 929 115 A1 | 7/1999 | H01Q/1/24 |
| EP | 1 037 330 A2 | 9/2000 | H01R/13/703 |
| GB | 2 345 022 A | 6/2000 | B29C/45/16 |
| WO | WO 00/39883 | 7/2000 | H01Q/1/24 |

OTHER PUBLICATIONS

PCT Search Report, mailed Jun. 20, 2002.

* cited by examiner

*Primary Examiner*—Tan Ho
(74) *Attorney, Agent, or Firm*—Robert J. Zeitler

(57) ABSTRACT

An antenna structure and assembly are provided, along with a method of fabricating the same. The antenna structure is formed by molding a plateable plastic antenna element in the desired shape of the antenna structure. The molded antenna element is plated substantially entirely thereabout with a conductive metal material. The antenna assembly includes the molded and plated antenna structure attached to a dielectric base structure adapted for mounting on an appropriate support such as a printed circuit board. A contact spring clip is interengaged between the antenna structure and the circuit board.

22 Claims, 7 Drawing Sheets

ANTENNA STRUCTURES

BACKGROUND OF THE INVENTION

This invention generally relates to antenna structures and antenna assemblies used with wireless communication apparatus and including a method of fabricating an antenna structure.

Antenna structures or assemblies have been used in wireless communication equipment such as in the radio telephone art, personal base stations, portable handsets and other communication terminals which are small, compact and lightweight. Considerable efforts have been made to fabricate such antennas in an efficient manner, particularly when the antennas are used with miniaturized electronic and radio frequency circuitry, but such efforts continue to be plagued with cost, fabrication and use problems.

For instance, some antennas are stamped and formed of sheet metal material, with selected contact portions being plated with precious metal. This stamping is quite flexible and rather "flimsy". Consequently, a separate rigid base structure of dielectric material, such as molded plastic, is provided for attaching the stamped and formed antenna thereto. The separate base structure typically has some form of mounting means for mounting the assembly on another structure such as a printed circuit board. The separate stamping and separate molding processes are unduly expensive, particularly in automated processes. In addition, it is difficult to maintain true tolerances, and this causes connection problems if the stamped antenna is to be electrically connected to a printed circuit board.

In order to avoid the tolerance problems of the stamped and formed antennas as described above, other antennas have also been made by a two-shot molding process which involves molding the dielectric base structure with two different plastic materials. Specifically, a mounting portion of the base structure is molded of a plastic material which can be utilized for mounting on another structure such as a printed circuit board. This first material typically is not plateable. A second plateable plastic portion then is molded over the first portion. Selective areas of the second, plateable plastic portion then are plated with metal antenna material in an electroless plating process. Although this type of antenna has better tolerances than the stamped antennas described above, this two-shot molding and selective plating procedure is quite expensive, involving expensive tooling, multiple processes and materials.

The present invention is directed to solving these various problems of prior art antennas and methods of fabrication as described above, and to provide an improved antenna structure and assembly along with a new more robust method of fabricating the same.

SUMMARY OF THE INVENTION

A general object, of the present invention is to provide a new and improved antenna structure of the character described.

Another object of the present invention is to provide an inexpensive dual band antenna for use in wireless handsets, portable computers and other electronic devices.

A further object of the invention is to provide a new and improved method of fabricating an antenna structure.

In the exemplary embodiment of the invention, an antenna structure includes a dielectric plastic core configured in the desired shape of the antenna structure. A conductive metal plating is applied over substantially the entire dielectric plastic core.

The invention contemplates attaching the above antenna structure to a dielectric base structure which is adapted for mounting on an appropriate support, substrate or the like, such as a printed circuit board. Specifically, complementary interengaging attachment means are provided between the base structure and the antenna structure to secure the antenna structure on the base structure.

As disclosed herein, the plated dielectric plastic core may be substantially planar in configuration. According to one aspect of the invention, the complementary interengaging attachment means between the base and antenna structures is provided by at least one attachment post on the base structure press-fit into an attachment hole in the antenna structure. According to another aspect of the invention, the base structure is molded of plastic material, and the complementary interengaging attachment means include portions of the base structure overmolded about portions of the antenna structure.

As disclosed herein, the base structure is adapted for mounting on a printed circuit board. A feature of the invention comprises a conductive contact clip interengaged between the antenna structure and the circuit board. The conductive contact clip is provided by a metal spring clip mounted on an arm of the antenna structure. The arm extends over the base structure toward the printed circuit board.

The method of fabricating the antenna structure according to the invention includes plating the molded plastic core by an electroplating process. The method also contemplates molding a plurality of the plastic cores in a multi-core array joined by an integrally molded carrier structure. The cores subsequently are severed from the carrier structure. The cores may be gang plated prior to being severed from the carrier structure, or the cores may be individually plated after severance.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 13A:
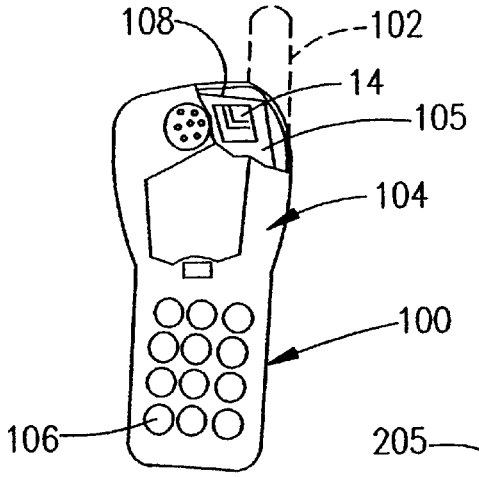
FIG. 13A is a plan view, partially in section of one wireless communications device in which the present invention may be used.

The present invention is directed to novel and useful antennas that are intended for dual band use in wireless communication applications. These applications will typically include handheld wireless handsets such as cellular telephones and portable computers, such as laptop computers. FIG. 13A illustrates a conventional wireless handset 100 that takes the form of a Nokia-style cellular telephone. In the past, such a handset 100 included an exterior antenna 102 that projected from a plastic housing 104. A circuit board 105 is supported within the housing 104 and contains various circuitry components necessary to the operations of the telephone, which are activated by various switches including a keypad 106. Antennas 14 of the present invention may be mounted on the circuit board 105 within the telephone internal circuitry 108, thus eliminating the need for an exterior projection 102 molded or otherwise attached to the telephone housing 104. In this regard, it should be noted that the typical dimensions of such a telephone 100 are approximately 1½ to 2 inches wide by 1 inch wide by 4 inches long. Thus, the interior cavity dimensions where the antenna 14 is mounted are much less and accordingly, the size of the antennas 14 of the invention will be slightly less than 2 square inches (approximately 30×38 mm) and as such as approximately 19×38 mm (slightly greater than 1 square inch).

Figure 13B:
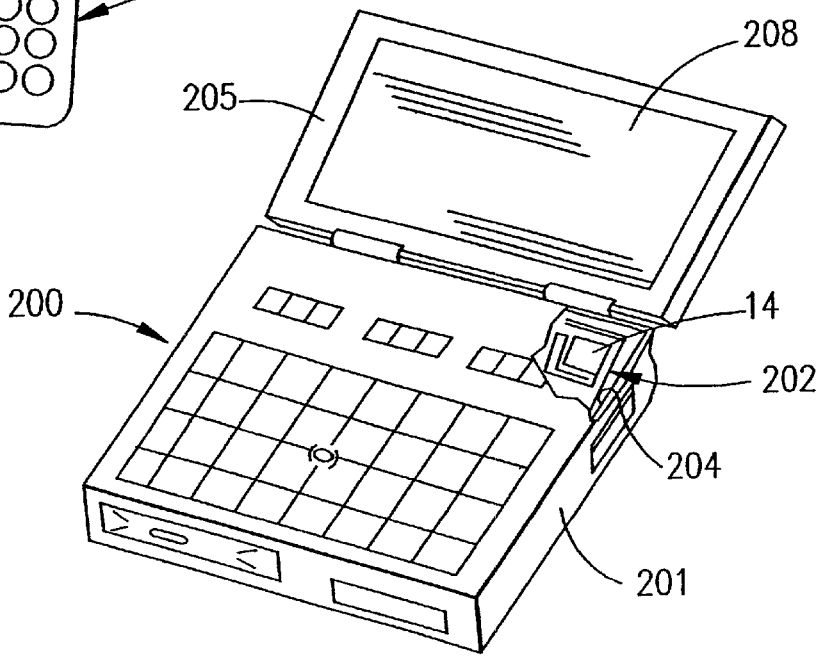
FIG. 13B is a perspective view, partially in section of another wireless communication device in which the present invention may be used.

FIG. 13B illustrates the environment for another application. This time in the wireless communications area 202 of a portable, a laptop computer 200. Similar to the wireless handset 100, the portable computer 200 also has a plastic housing 201 that encloses one or more circuit boards 204 that supports a variety of electronic components. This circuit board will also support the antennas 14 of the present invention, thus eliminating the need for an external antenna assembly. The antenna 14 may also be mounted in a similar arrangement within the cover portion 205 of the computer 200 that holds the display screen 208.

Figure 1:
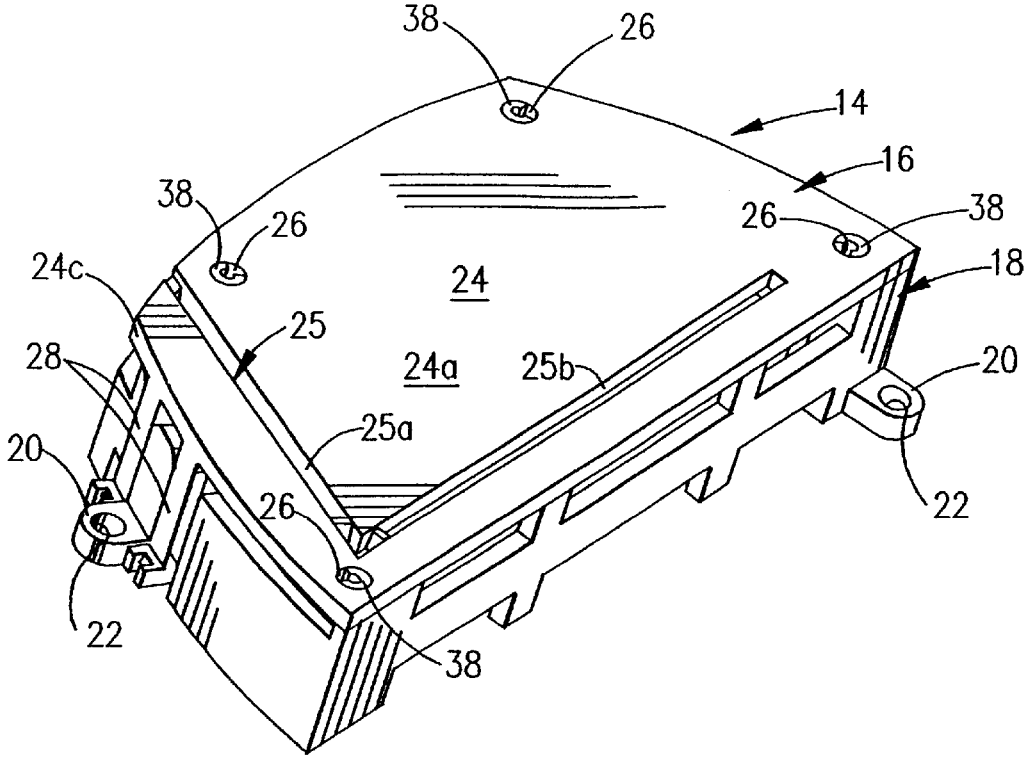
FIG. 1 is a top perspective view of an antenna assembly according to the invention.
Figure 2:
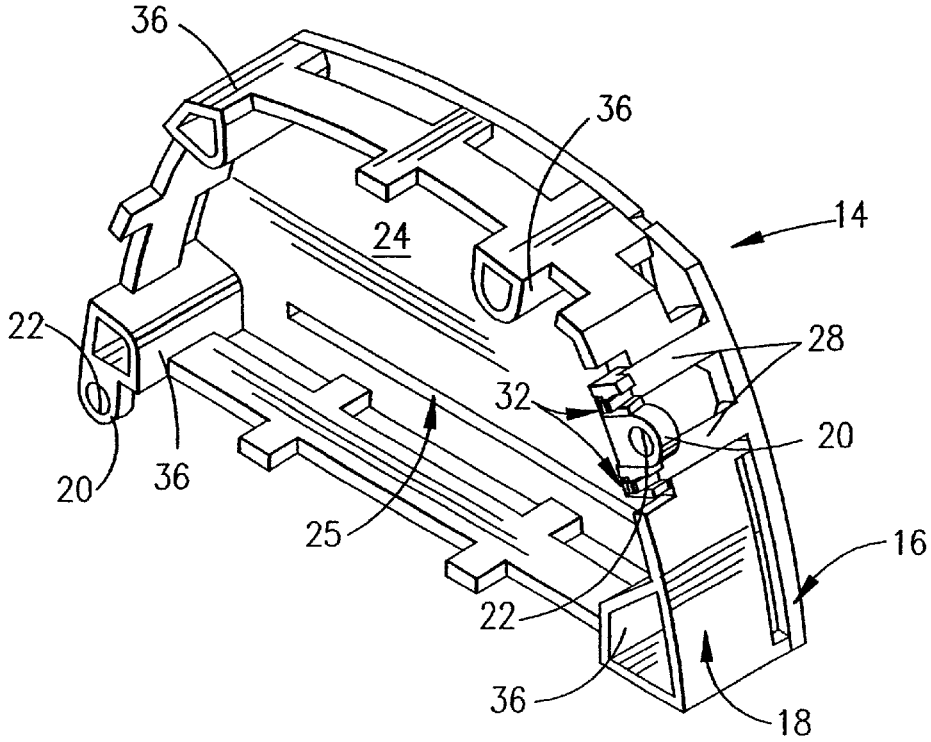
FIG. 2 is a bottom perspective view of the assembly of FIG. 1.

Referring to the drawings in greater detail, and first to FIGS. 1 and 2, the invention is embodied in an antenna assembly, generally designated 14, which includes an antenna structure, generally designated 16, attached to the top of a base structure, generally designated 18. The base structure has a plurality of mounting feet 20 which are provided with through holes 22 for receiving appropriate fasteners, such as screws (not shown), for mounting antenna assembly 14 on an appropriate support, such as a printed circuit board. It is contemplated that the antenna structure 16 will be mounted in the housing of a telecommunications device (not shown), either with or without the use of the base structure 18.

Figure 3:
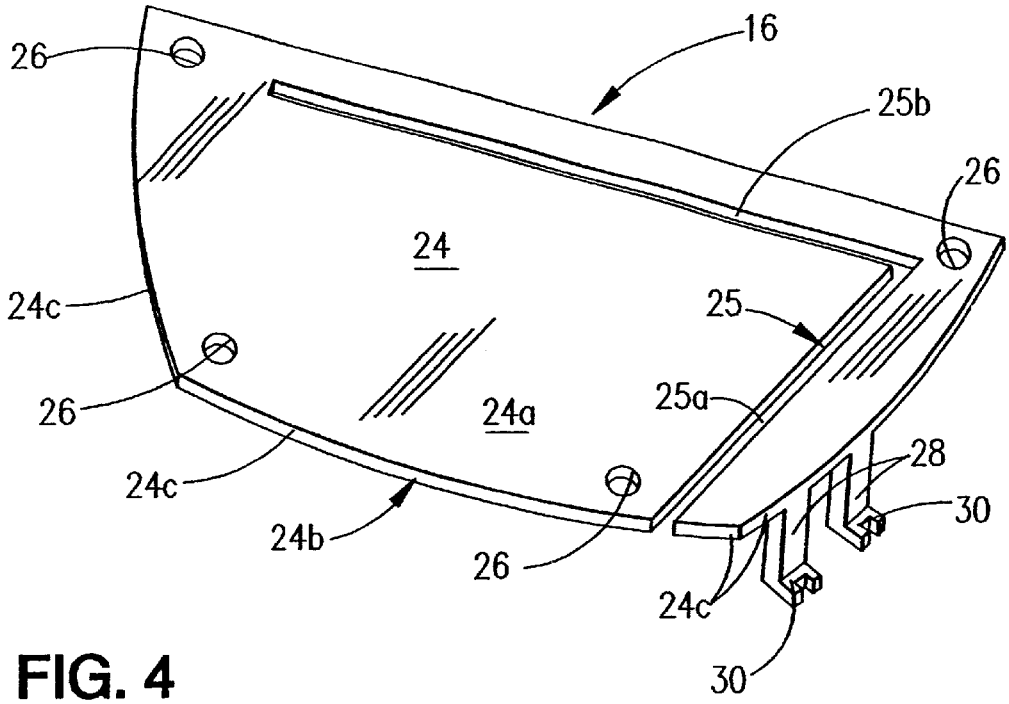
FIG. 3 is a top perspective view of the antenna structure of the assembly.
Figure 4:
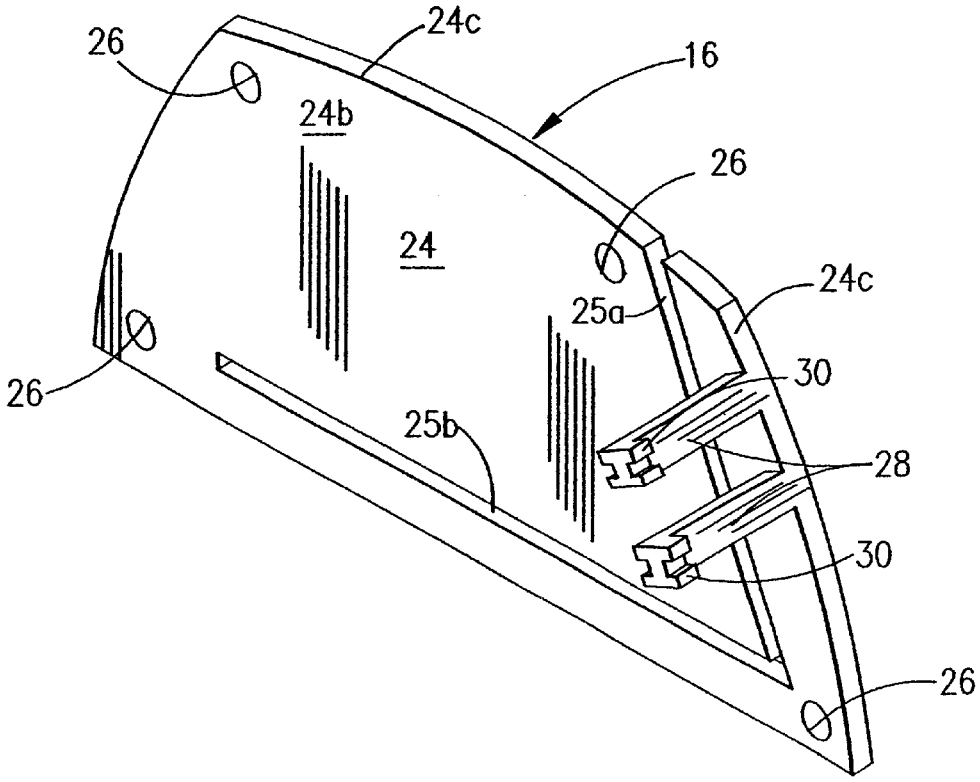
FIG. 4 is a bottom perspective view of the antenna structure of FIG. 3.

Referring to FIGS. 3 and 4 in conjunction with FIGS. 1 and 2, antenna structure 16 of antenna assembly 14 may be substantially planar in configuration as defined by a generally flat body 24. The body has a plurality of attachment holes 26. A pair of arms 28 depend from the body and terminate in slotted feet 30. The arms are provided for mounting a pair of contact spring clips, generally designated 32 (FIG. 2), as will be seen in greater detail hereinafter. The contact spring clips are flexible and provide contact means between antenna structure 16 and appropriate circuit traces on the printed circuit board. However, because the antenna structure 16 is formed from a plateable plastic material, it is not limited to a the exact configuration as shown in FIGS. 3 and 4. Rather, as set for the above the antenna structure 16 can take the form of any shape necessary to comply with the dimensional requirements of the telecommunications device that the antenna structure is adapted for use in. The antennas of the present invention are dual board antennas, intended for use in both the AMPS or GSM bands at the low end, respectively 824–894 MHz and 890–960 MHz, and PCS or PCN bands at the high end, respectively 1.85–1.99 GHz and 1.71–1.88 GHz. However, as the size of the antenna decreases, there is some reduction in the operational bandwidths of the two bands.

FIG. 3 illustrates the antenna radiating element 16 separated from its support base 18. As seen in FIG. 3, the radiating element 16 preferably has a planar configuration in its body portion 24 with respective top and bottom surfaces 24*a,* 24*b* that are interconnected by a plurality of sidewalls 24*c*. In order to provide dual band performance to the antenna assembly 14, the radiating element 16 may be provided with a slot 25 as illustrated. In FIGS. 3 and 4, the slot 25 is shown as having two leg, or arm portions, 24*c,* 25*b* that diverge from each other. The dimensions and placement of this slot may be modified in order to affect the operational characteristics of the antenna assembly 14. The radiating element 16 may not include the slot, if single board performance is desired.

Antenna structure 16 is fabricated individually or in a multi-antenna array as described hereinafter. In either event, the antenna structure is fabricated by molding a plateable plastic antenna element configured in a desired shape of the antenna structure, such as the shape shown in FIGS. 3 and 4 and described above. The molded antenna radiating element 16 then is plated with conductive metal in an electroplating process to entirely cover the molded plastic antenna element, meaning all of the exposed surfaces shown in FIGS. 3 and 4. As a minimum, it is desired to have the top and bottom surfaces 24*a,* 24*b* of the radiating element 16 and at least one interconnecting sidewall 24*c* plated. Plating all the surfaces reduces the manufacturing cost. Therefore, as viewed in FIGS. 3 and 4, antenna radiating element 16 is substantially entirely covered by the conductive plating material.

Figure 5:
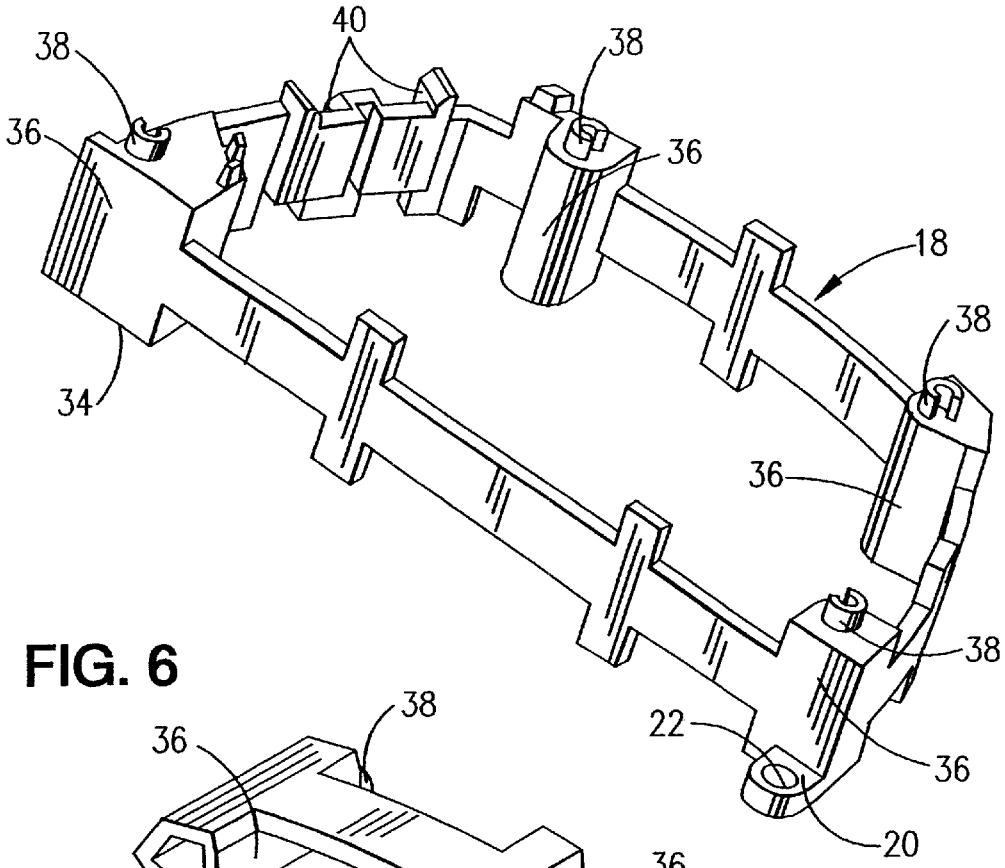
FIG. 5 is a top perspective view of the base structure of the assembly.
Figure 6:
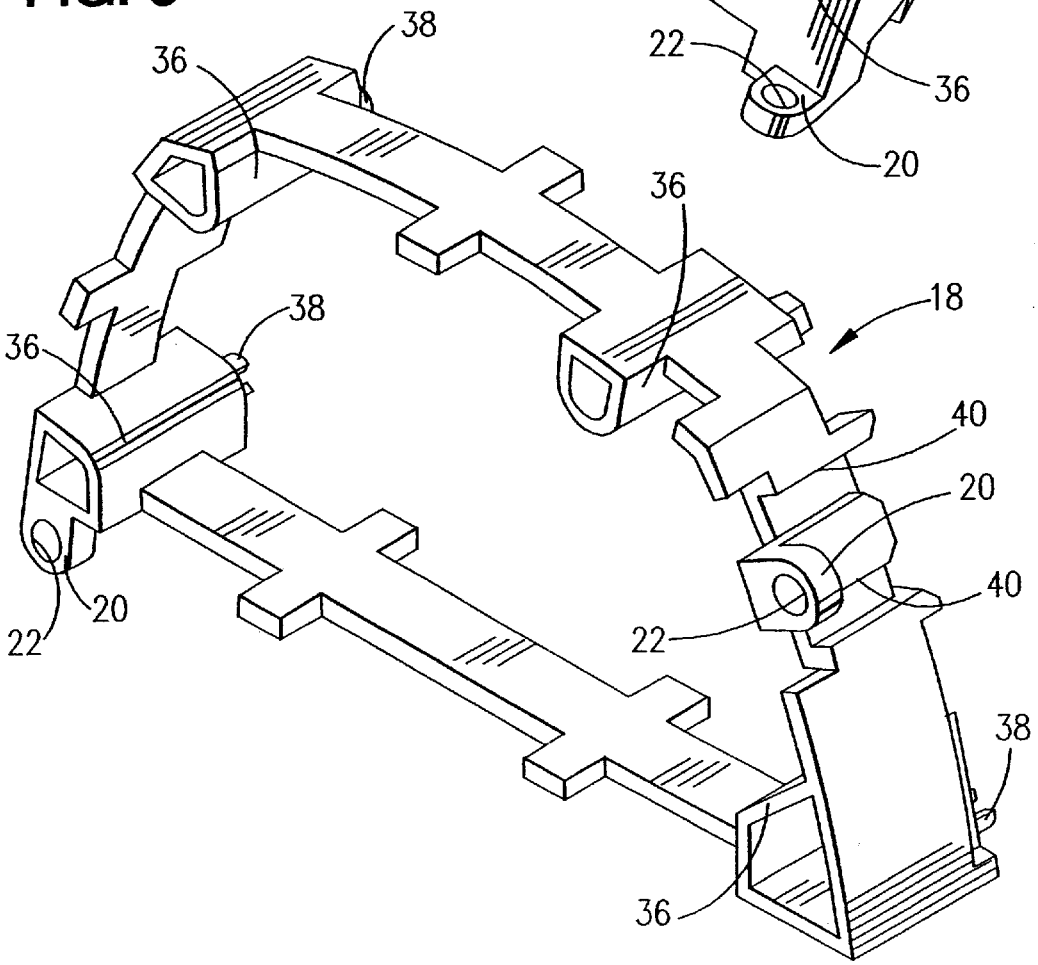
FIG. 6 is a bottom perspective view of the base structure.

Referring to FIGS. 5 and 6 in conjunction with FIGS. 1 and 2, base structure 18 of antenna assembly 14 is a one-piece structure unitarily molded of plastic material or the like. The base structure has a mounting face 34 which includes mounting feet 20 for mounting the base structure on the printed circuit board by appropriate fasteners through holes 22 in feet 20. Four upstanding posts 36 have C-shaped attachment bosses 38 molded integrally at the tops of the posts. As seen in FIG. 1, antenna structure 16 is attached to the top of base structure 18 by inserting attachment bosses 38 of the base structure into attachment holes 26 in the antenna structure. This can be performed by dimensioning the bosses and the holes to establish a press-fit therebetween to secure the antenna structure to the top of the base structure. Finally, as best seen in FIG. 6, base structure 18 has a pair of grooves 40 on opposite sides of one of the mounting feet 20 for receiving arms 28 depending from the antenna structure.

Figure 7:
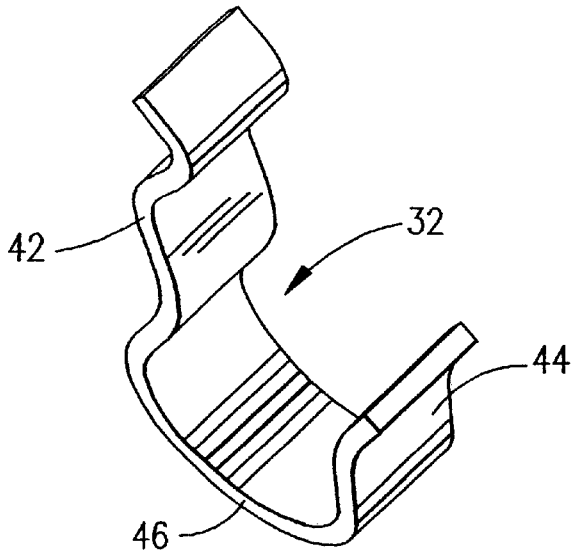
FIG. 7 is an enlarged perspective view of one of the contact spring clips.

FIG. 7 shows an enlarged depiction of one of the contact spring clips 32 which are mounted in the bottom distal ends of arms 28 of the antenna structure. Each contact spring clip is generally U-shaped to define an undulated fixing leg 42 and a free leg 44, the legs being joined by an outwardly bowed contact portion 46 of the contact spring clip. The spring clip is stamped and formed of conductive spring metal material.

Figure 8:
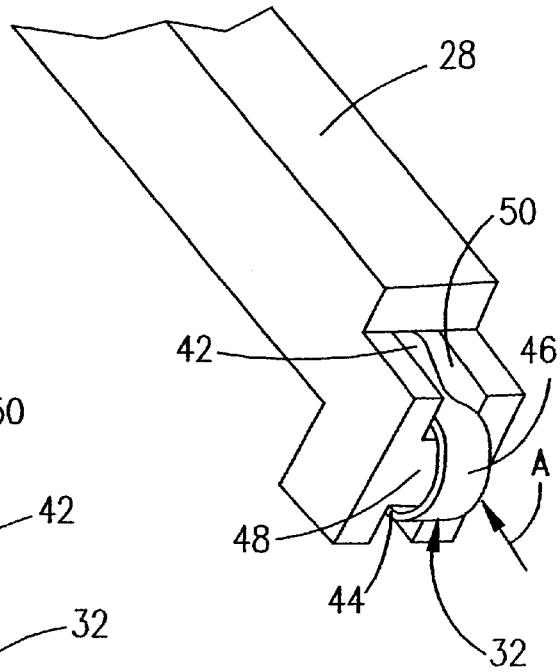
FIG. 8 is an enlarged perspective view of the contact spring clip mounted to the bottom of one of the arms of the antenna structure.
Figure 9:
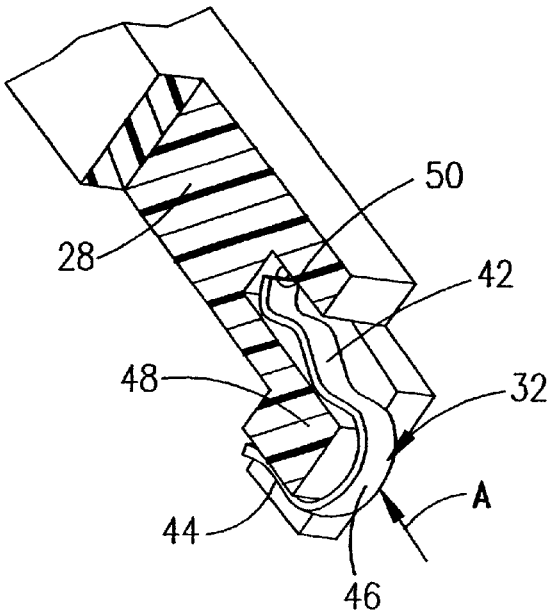
FIG. 9 is a view similar to that of FIG. 8, partially in section, to show the cavity in the arm which receives the contact spring clip.

FIGS. 8 and 9 show one of the contact spring clips 32 mounted in the distal end of one of the arms 28 of the antenna structure. Specifically, the U-shaped contact spring clip 32 embraces a block portion 48 of the arm, as the undulated leg 42 of the spring clip is press-fit into a slot 50 in the bottom of the arm. Free leg 44 of the contact spring clip is free to move as pressure is applied to contact portion 46 of the spring clip in the direction of arrow "A". In other words, as antenna assembly 14 (FIGS. 1 and 2) is mounted to the printed circuit board by fasteners inserted through holes 22 in mounting feet 20, the assembly is drawn onto the board. In response, the board engages contact portions 46 of spring clips 32 and biases the spring clips in the direction of arrows "A". Keeping in mind that substantially the entirety of antenna structure 16 is plated with conductive material, the antenna structure is conductively coupled to appropriate circuit traces on the printed circuit board through arms 28 and contact spring clips 32.

Alternatively, the antenna structure 16 may be mounted to an internal surface of the housing of the telecommunications device by fastening members (not shown) engaged with attachment holes 26 of the antenna structure. When the antenna structure 16 is brought into engagement with its corresponding circuit substrate, the circuit substrate engages contact portion 46 of the spring clip 32 in a biased manner.

Figure 10:
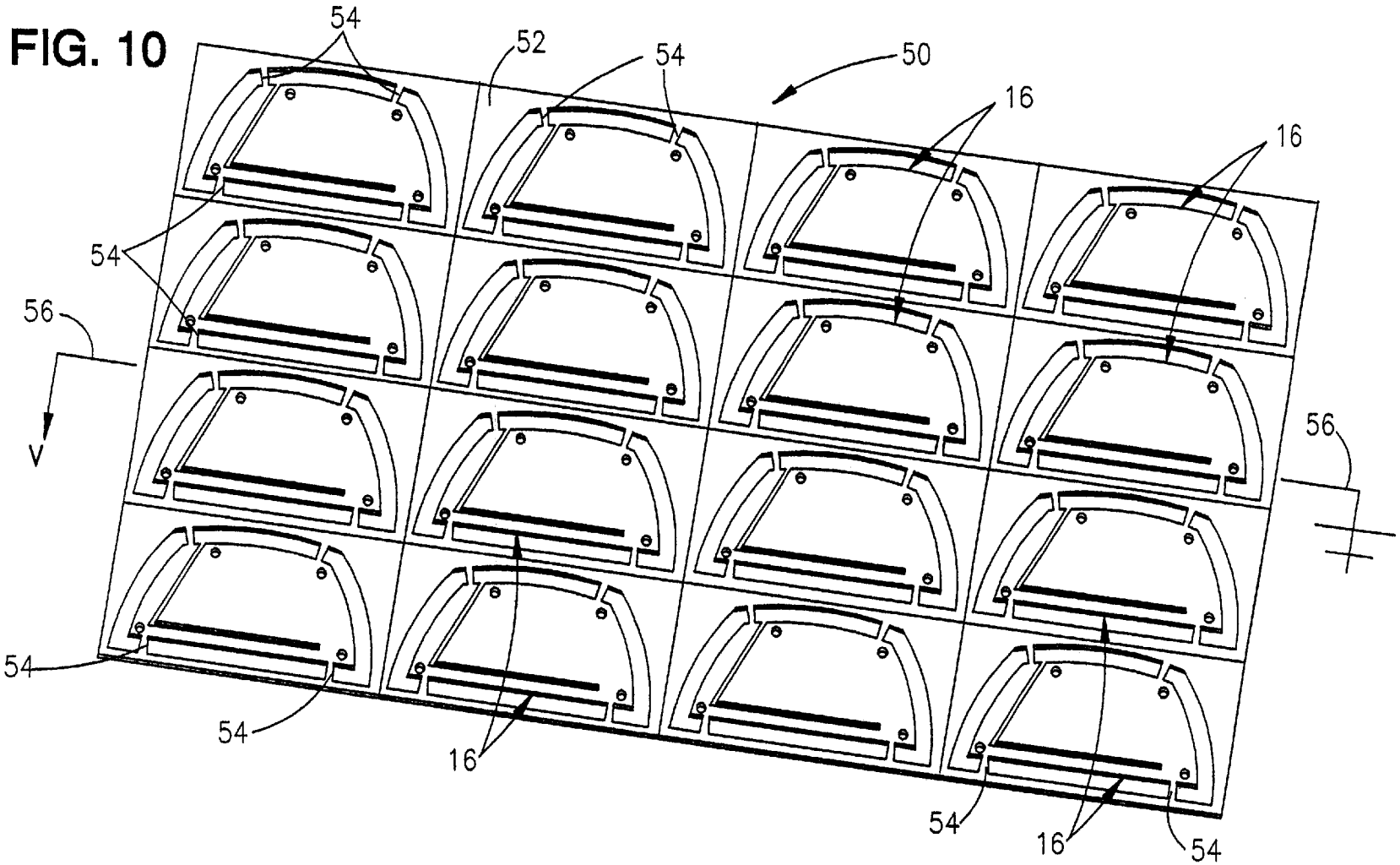
FIG. 10 is a top perspective view of an array of the antenna structures during processing.
Figure 11:
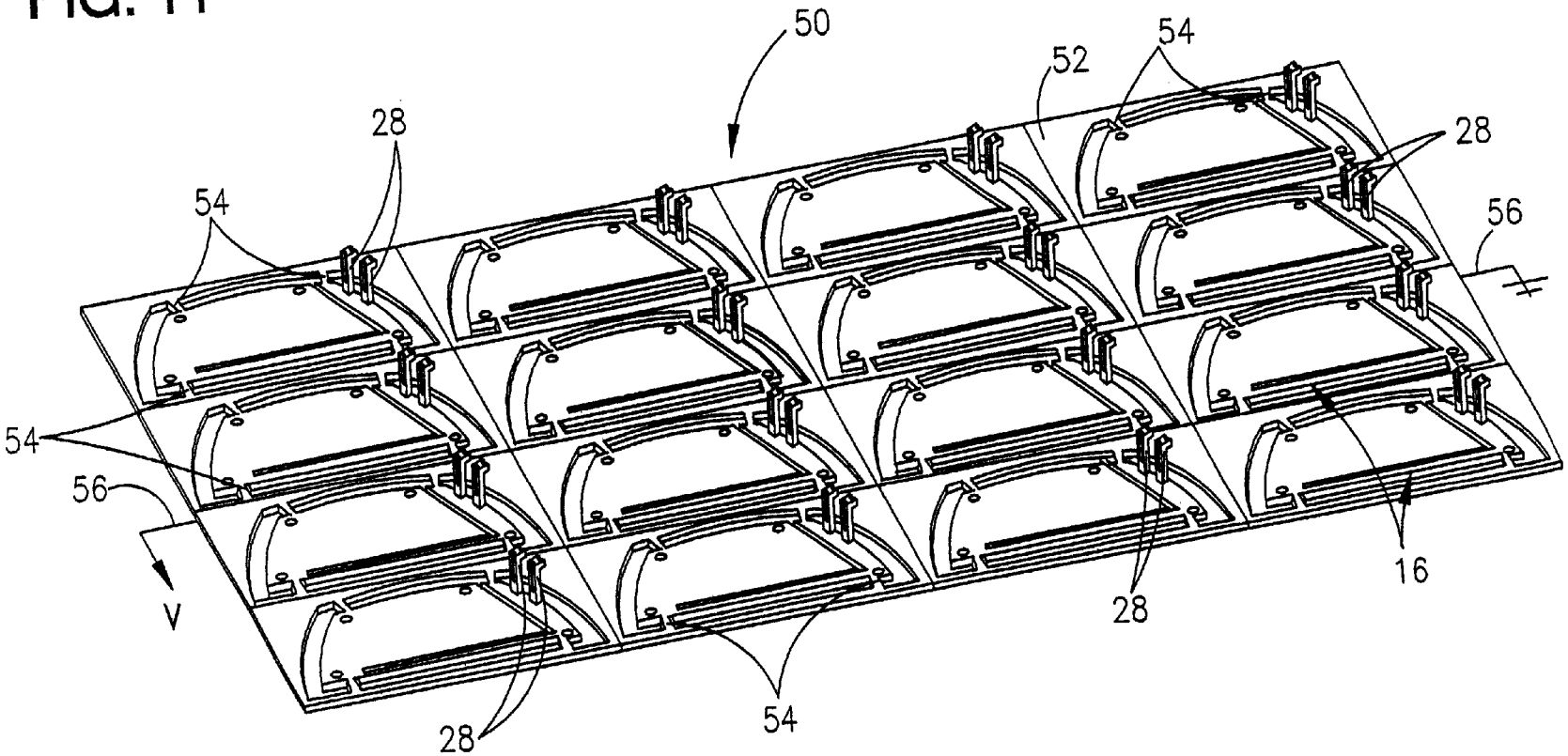
FIG. 11 is a bottom perspective view of the array of FIG. 10.

FIGS. 10 and 11 show a method of fabrication which includes fabricating a plurality of antenna structures 16 in a multi-antenna array, generally designated 52. Specifically, the plateable plastic antenna elements are gang molded and joined by an integrally molded carrier structure 52. The individual molded plastic antenna elements are joined to the carrier structure by a plurality of webs 54. Gang molding of the plurality of plateable plastic antenna elements significantly reduces the costs of manufacture. The plastic material of the antenna elements is selected from a plateable material such as polypropylene or the like, but other plateable material such as nylon or ABS is contemplated.

After the array 50 of plateable plastic antenna elements is molded as described above, the entire array including carrier structure 52 is appropriately electrically coupled, as at 56, in an electro-plating bath and the entire multi-antenna structure is electro-plated with conductive metal material, such as a copper/nickel alloy or the like. The electroplating process is significantly faster and less expensive than the electroless plating processes of the prior art.

After plating the plateable plastic antenna elements, antennas 16 (FIGS. 10 and 11) are severed from carrier structure 52 by cutting webs 54. The antenna structures then are ready to be attached to a plurality of base structures 18 to form a plurality of antenna assemblies 14 as shown in FIGS. 1 and 2.

An alternative method of fabrication would be to first gang mold a plurality of plateable plastic antenna elements including carrier structure 52 and webs 54 as seen in FIGS. 10 and 11. The molded plastic antenna elements then would be severed from carrier structure 52 by cutting webs 54, and the individual molded plastic antenna elements then can be substantially entirely plated in an electro-plating bath.

Figure 12:
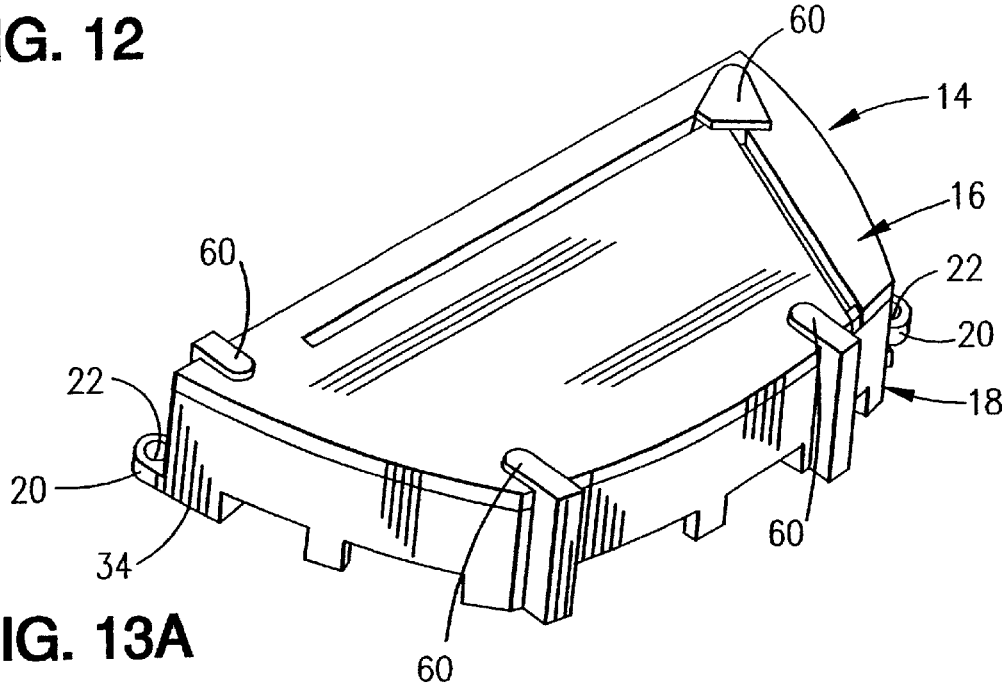
FIG. 12 is a view similar to that of FIG. 1, but of an alternative embodiment of the invention.

FIG. 12 shows an antenna assembly 14 which includes an alternative embodiment of attaching antenna structure 16 to base structure 18. Specifically, attachment holes 26 in the antenna structure and attachment bosses 38 of the base structure as described above in relation to FIGS. 1–6 have been eliminated. As stated above, base structure 18 is molded of plastic material. In the alternative embodiment of FIG. 12, after antenna structure 16 is molded and plated, it is properly positioned in a mold for base structure 18, and integral portions 60 of the base structure are overmolded onto the top of the antenna structure to securely attach the antenna structure to the base structure.

From the foregoing, it can be understood that the various embodiments of the structure and method of the invention have distinct advantages over the prior art described above. Specifically, the unique structure of the invention has the superior antenna characteristics of a stamping while maintaining the design freedom of a molding. The molded plateable plastic antenna element of the antenna structure is very cost effective in both tooling costs and lead times or speed. The choice of plastic materials to provide a robust structure can vary. The antenna elements can be efficiently molded in a multi-antenna array. The plastic antenna elements can be repeatedly molded with tight tolerances as will be needed in wireless telephones and portable computers. Electro-plating substantially the entire plastic antenna element also is cost effective in comparison to selective plating of portions of an antenna. In addition, electro-plating is many times faster than electroless plating. Insert molding the antenna structure by overmolding a base structure thereto also is cost and performance effective. Importantly, the small size of the antennas of the present invention lends itself to easy use in wireless handset, portable computers and other small electronic devices.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An antenna assembly, comprising:

a dielectric base for mounting on a circuit board;

a plateable plastic antenna radiating element and a conductive metal plating covering the plateable plastic antenna radiating element; and complementary interengaging attachment means between the base and said radiating element.

2. The antenna assembly of claim 1 wherein the said radiating element is substantially planar in configuration.

3. The antenna assembly of claim 1 wherein said complementary interengaging attachment means include at least one attachment post on the base press-fit into an attachment hole in the radiating element.

4. The antenna assembly of claim 1 wherein said base is molded from a plastic material, and said complementary interengaging attachment means include portions of the base overmolded about portions of the radiating element.

5. The antenna assembly of claim 1 wherein said base includes a conductive contact clip for contacting the circuit board.

6. The antenna assembly of claim 5 wherein said conductive contact clip includes a metal spring clip.

7. The antenna assembly of claim 5 wherein said radiating element includes an arm extending therefrom over the base toward the circuit board, said contact clip being located generally at a distal end of the arm.

8. The antenna assembly of claim 1 including a conductive contact clip in contact with a plated portion of the antenna element.

9. An inexpensive antenna radiating element, comprising:

a planar body portion formed from a plastic that is plateable with metal; a conductive metal layer plated to said body portion, the metal layer being plated to at least opposing top and bottom surfaces of said body portion and said metal layer further being plated to at least one interconnecting surface of said body portion that extends between said body portion top and bottom surfaces to electrically interconnect said body portion top and bottom surfaces; and at least one arm member extending from said body portion for connecting said body portion to a circuit board, at least a portion of said arm member being plated with said metal layer to electrically interconnect said radiating element to the circuit board.

10. The antenna radiating element of claim 9, wherein said body portion includes a slot extending therein which permits said radiating element to operate in two different band widths when energized.

11. The antenna radiating element of claim 10, wherein said slot has two different segments that extend at an angle to each other.

12. The antenna radiating element of claim 9, wherein all surfaces of said body portion are plated with said metal layer.

13. An antenna structure for use in a portable wireless telecommunication device, the telecommunication device having an exterior housing and a circuit substrate, the circuit substrate having electrical circuitry and components to operate the telecommunication device, the antenna structure comprising:

a single shot plateable plastic antenna element configured in the desired shape of the antenna structure; and a conductive metal plating substantially entirely covering the plateable plastic antenna element, wherein the antenna element is adapted for mounting on an internal surface of the telecommunication device external housing.

14. The antenna structure of claim 13 wherein the antenna element is attached to a dielectric base structure adapted for mounting on the circuit substrate.

15. The antenna structure of claim 13 including a conductive contact clip interengaged between the antenna structure and the circuit substrate.

16. The antenna structure of claim 13 wherein the plateable plastic antenna element is substantially planar in configuration.

17. A method of fabricating an antenna structure, comprising the steps of:

molding a plateable plastic antenna element in the desired shape of the antenna structure by a single shot molding method; and plating the molded antenna element substantially entirely thereabout with a conductive metal material, wherein the antenna element is substantially planar.

18. The method of claim 17 wherein said plating step is carried out by an electro-plating process.

19. The method of claim 17, including the step of attaching the antenna structure to a dielectric base structure.

20. The method of claim 19 wherein said base structure is molded of plastic material with portions thereof overmolded about portions of the antenna structure to attach the antenna structure to the base structure.

21. The method of claim 17, including molding a plurality of said plateable plastic antenna elements in a multi-antenna element array joined by an integrally molded carrier structure, and subsequently severing the antenna elements from the carrier structure.

22. The method of claim 21 wherein said antenna elements are plated prior to being severed from the carrier structure.

* * * * *